US005888123A

United States Patent [19]

Wang

[11] Patent Number: 5,888,123

[45] Date of Patent: Mar. 30, 1999

[54] AUTOMATIC GOLF CLUB GRINDER

[76] Inventor: Kun-I Wang, No. 18, Hsih-Kuang Rd., Hsih-Chih Tsun, Wan-Luan Hsiang, Pingtung Hsien, Taiwan

[21] Appl. No.: 854,448

[22] Filed: May 14, 1997

[51] Int. Cl.[6] ..... B24B 19/00

[52] U.S. Cl. ..... 451/65; 451/182; 451/190; 451/302

[58] Field of Search ..... 451/65, 296, 302, 451/190, 182

[56] References Cited

U.S. PATENT DOCUMENTS

| | | | |
|---|---|---|---|
| 3,895,464 | 7/1975 | Kiser | 451/190 |
| 4,305,231 | 12/1981 | Rasmussen | 451/65 |
| 4,335,542 | 6/1982 | Howe | 451/65 |
| 4,766,698 | 8/1988 | Solomko | 451/226 |
| 5,168,656 | 12/1992 | Jolly et al. | 451/65 |
| 5,199,220 | 4/1993 | Steiner et al. | 451/65 |

*Primary Examiner*—Robert A. Rose
*Assistant Examiner*—George Nguyen
*Attorney, Agent, or Firm*—Varndell Legal Group

[57] ABSTRACT

A golf club grinder including a base frame, a first grinding mechanism and a second grinding mechanism respectively mounted on the base frame for grinding the hosel and the shaft respectively, the first grinding mechanism including an abrasive belt mounted on a wheel and a roller and driven by a motor to grind the hosel of a golf club, the second grinding mechanism including a forwardly tilted motor mounted on a motor carrier and moved relative to the abrasive belt, and a grinding wheel turned by the forwardly tilted motor to grind a shaft for golf club put in between the abrasive belt and the grinding wheel.

1 Claim, 5 Drawing Sheets

AUTOMATIC GOLF CLUB GRINDER

BACKGROUND OF THE INVENTION

The present invention relates to golf club grinders, and more particularly to an automatic golf club grinder which is practical for grinding the hosel of a golf club as well as the shaft for golf club.

Before fastening the shaft to the club head during the fabrication of a golf club, a hosel shall be installed. However, the front end of the shaft must be well ground and then covered with a layer of adhesive before fastening the shaft to the hosel. Further, when a golf club is assembled, the hosel must be well ground so that the hosel, the shaft and the neck of the club head can be maintained in a flush manner. When grinding the hosel or the shaft, the operator must hold the shaft and attach it to the grinding wheel and then turn the shaft when grinding. This grinding procedure is complicated, and the grinding quality is not easy to be controlled.

SUMMARY OF THE INVENTION

The present invention has been accomplished to provide a golf club grinding which can be operated to automatically grind the hosel of a golf club as well as the shaft for golf club.

According to one aspect of the present invention, the golf club grinder comprises a first grinding mechanism for grinding the hosel, and a second grinding mechanism controlled to act with the first grinding mechanism for grinding the shaft. According to another aspect of the present invention, the first grinding mechanism and the second grinding mechanism have a respective rack for holding the golf club or the shaft to be ground. According to still another aspect of the present invention, the motor of the second grinding mechanism is tilted forwardly downwards so that the shaft is gradually moved out of the grinding position when grinding. According to still another aspect of the present invention, the first grinding mechanism comprises a driving wheel mounted on the motor shaft of the motor thereof, a spring-supported roller holder assembly holding a roller and an arched guard above the roller, and an abrasive belt mounted on the driving wheel and the roller and turned by the driving wheel to grind the workpiece. When the arched guard is pressed down, the abrasive belt is loosened from the driving wheel and can be removed from the first grinding mechanism for a replacement.

DETAILED DESCRIPTION OF THE PREFERRED EMBODIMENT

Figure 1:
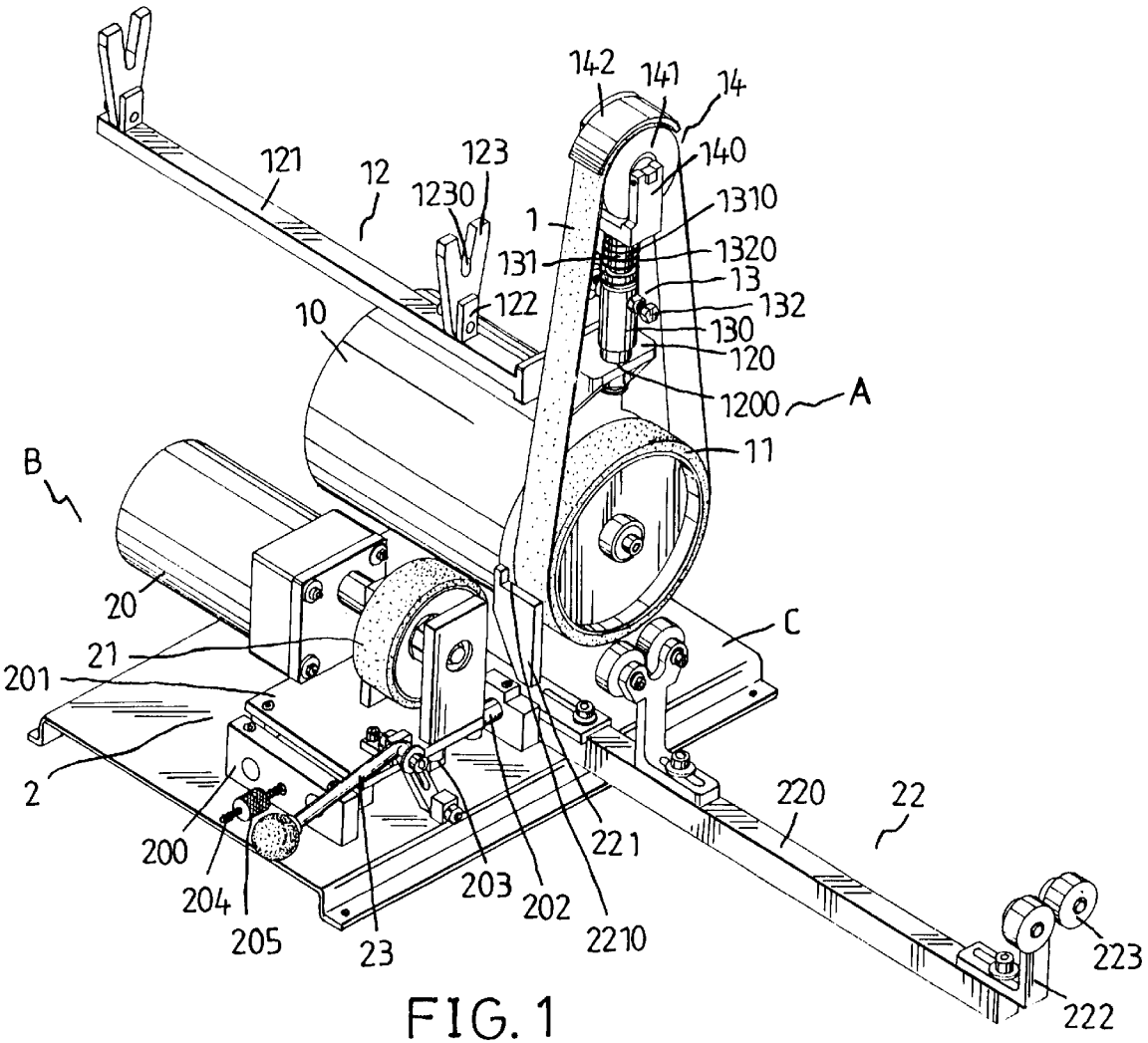
FIG. 1 is an elevational view of a golf club grinder according to the present invention.
Figure 2:
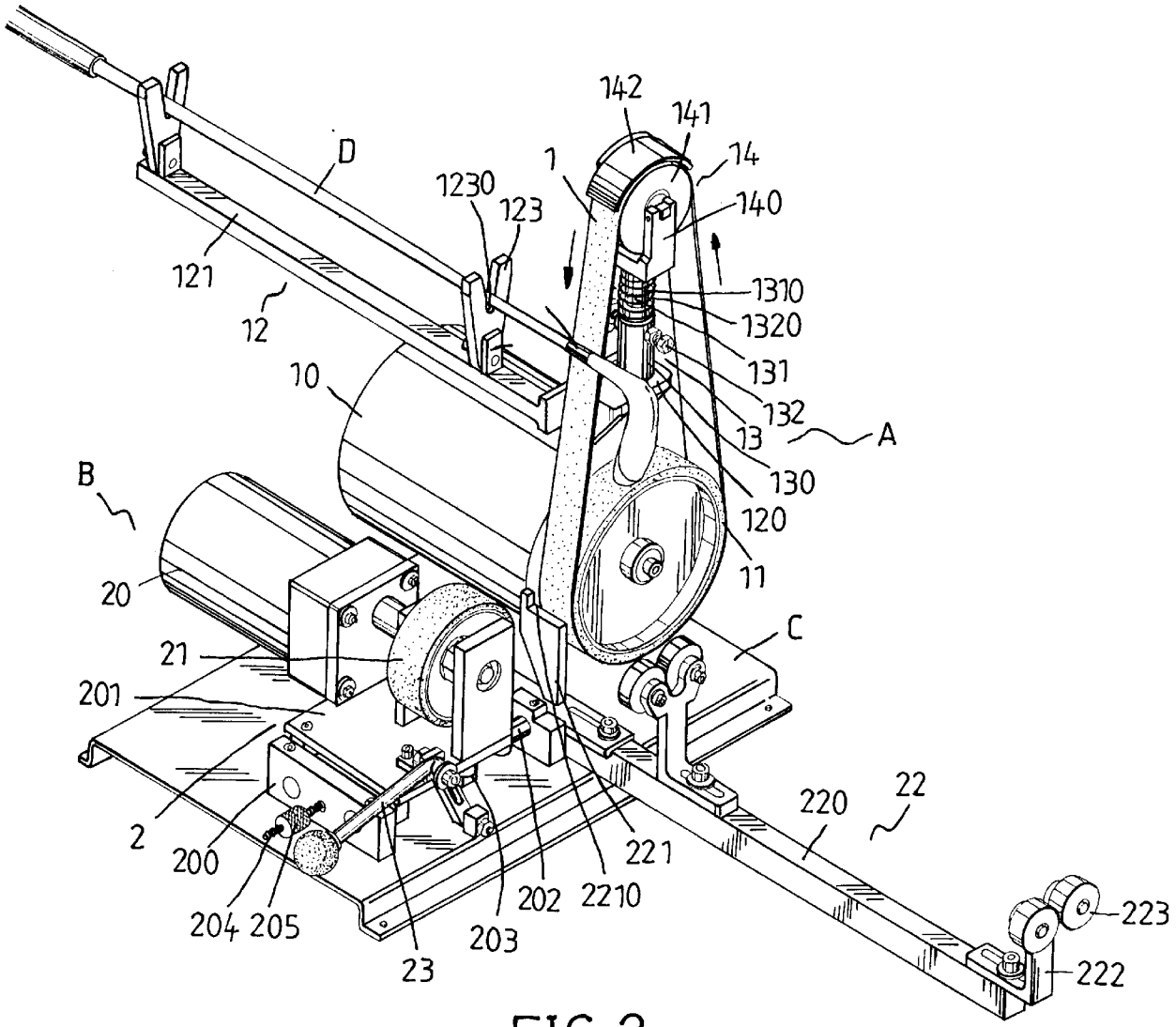
FIG. 2 is an applied view of the present invention, showing the hosel of a golf club ground by the first grinding mechanism.
Figure 3:
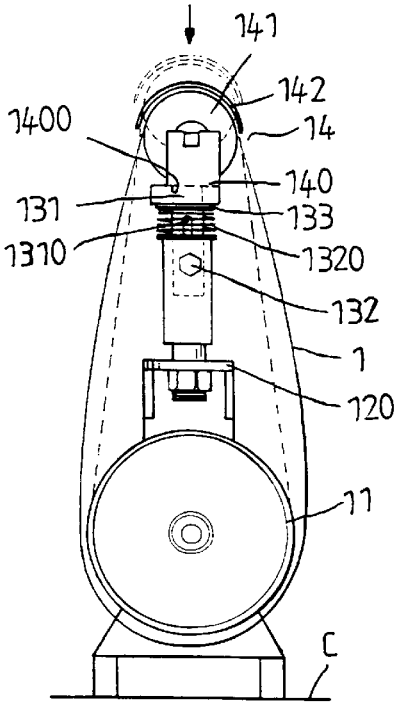
FIG. 3 is a schematic drawing showing the releasing of the abrasive belt from the first grinding mechanism according to the present invention.

Referring to FIGS. 1, 2 and 3, a golf club grinder in accordance with the present invention is generally comprised of a base frame C, a first grinding mechanism A mounted on the base frame C and adapted for grinding hosel for golf club, and a second grinding mechanism B mounted on the base frame C and adapted for grinding golf club shaft.

The first grinding mechanism A is comprised of an abrasive belt 1, a motor 10, a driving wheel 11, a rack 12, an adjustment device 13, and a roller holder assembly 14. The motor 10 is mounted on the base frame C at the top. The driving wheel 11 is fixedly mounted on the motor shaft of the motor 10. The rack 12 is fixedly mounted on the shell of the motor 10 at the top in a horizontal position, comprising a substantially L-shaped frame 120 having around hole 1200, an elongated bar 121 extended from one side of the L-shaped frame 120 and disposed in a horizontal position, two upright lugs 122 vertically raised from the elongated bar 121 near its two opposite ends, and two fork members 123 respectively fastened to the upright lugs 122 and defining a respective top gap 1230 for holding the workpiece (the golf club to be ground). The adjustment device 12 comprises a top-open socket 130 mounted in the round hole 1200 of the L-shaped frame 120, a round rod 131 inserted into the top-open socket 130 and having a longitudinal locating groove 1310, a tightening up screw 132 threaded into a screw hole (not shown) in the top-open socket 130 and stopped at the longitudinal locating groove 1310 to hold down the round rod 131 in the top-open socket 130, a spring 1320 mounted around the round rod 131 and stopped above the top-open socket 130, and a cushion 133 mounted around the round rod 131 and stopped between the spring 1320 and the roller holder assembly 14. The roller holder assembly 14 comprises a U-shaped roller holder 140 having a round hole 1400 at the center which receives the top end of the round rod 131, a roller 141 mounted on the U-shaped roller holder 140, and an arched guard 142 connected to the U-shaped roller holder 140 and spaced around the periphery of the roller 141 at the top. The abrasive belt 1 is mounted on the driving wheel 11 and the roller 141 and protected by the arched guard 142.

Referring to FIG. 2 again, when the golf club D is mounted in the top gaps 1230 of the fork members 123, the hose) D1 of the golf club D is disposed in contact with the abrasive belt 1. When the motor 10 is started, the abrasive belt 1 is turned to grind the hosel D1 of the golf club D.

Referring to FIG. 3 again, when to replace the abrasive belt 1, the tightening up screw 132 is loosened, then the arched guard 142 is pressed down to lower the roller 141, for permitting the abrasive belt 1 to be released from the driving wheel 11. After replacement, the tightening up screw 132 is fastened up again to fix the round rod 131 at the desired elevation.

Figure 4:
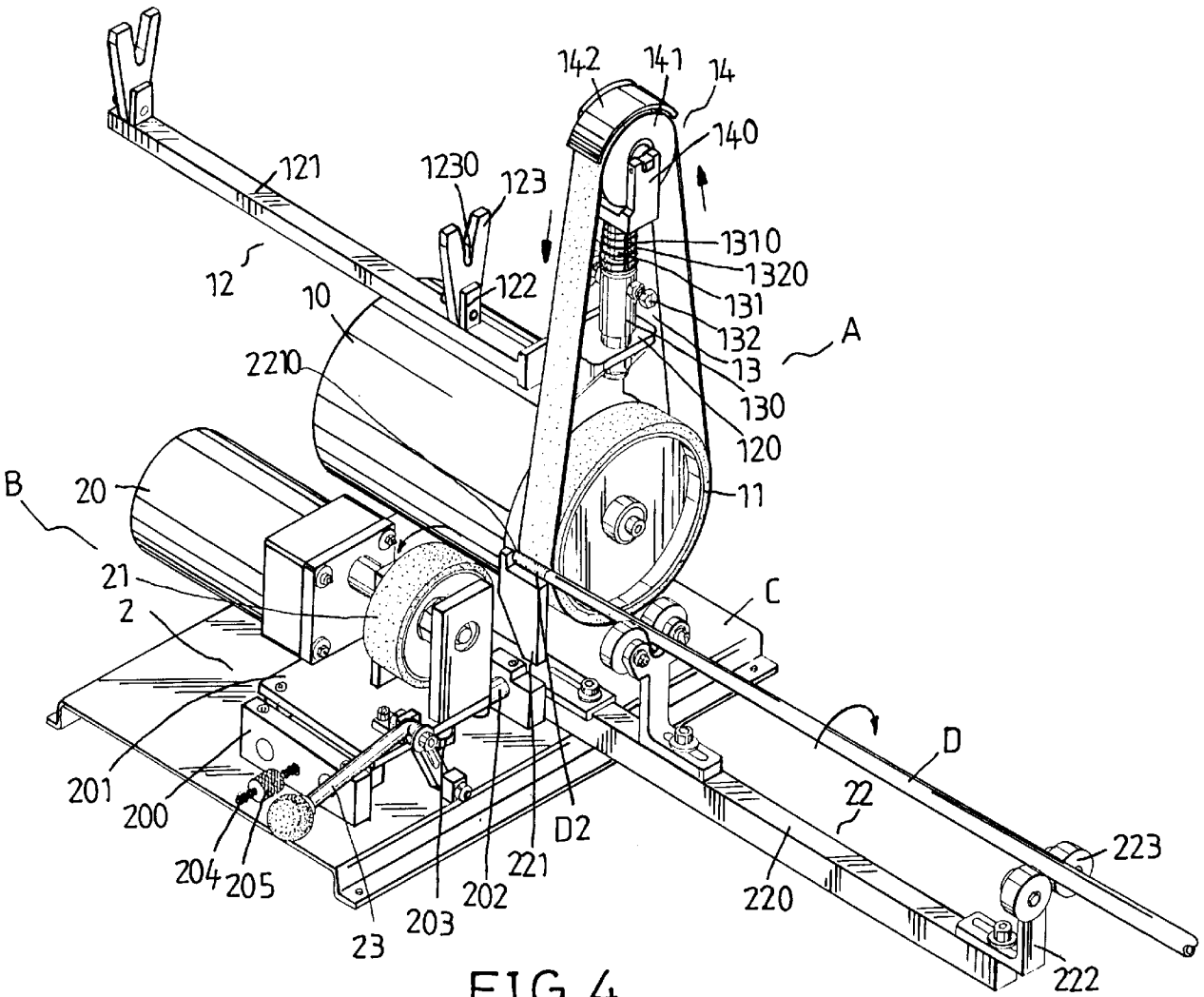
FIG. 4 is another applied view of the present invention, showing a shaft for golf club carried on the rack of the second grinding mechanism for grinding.
Figure 6:
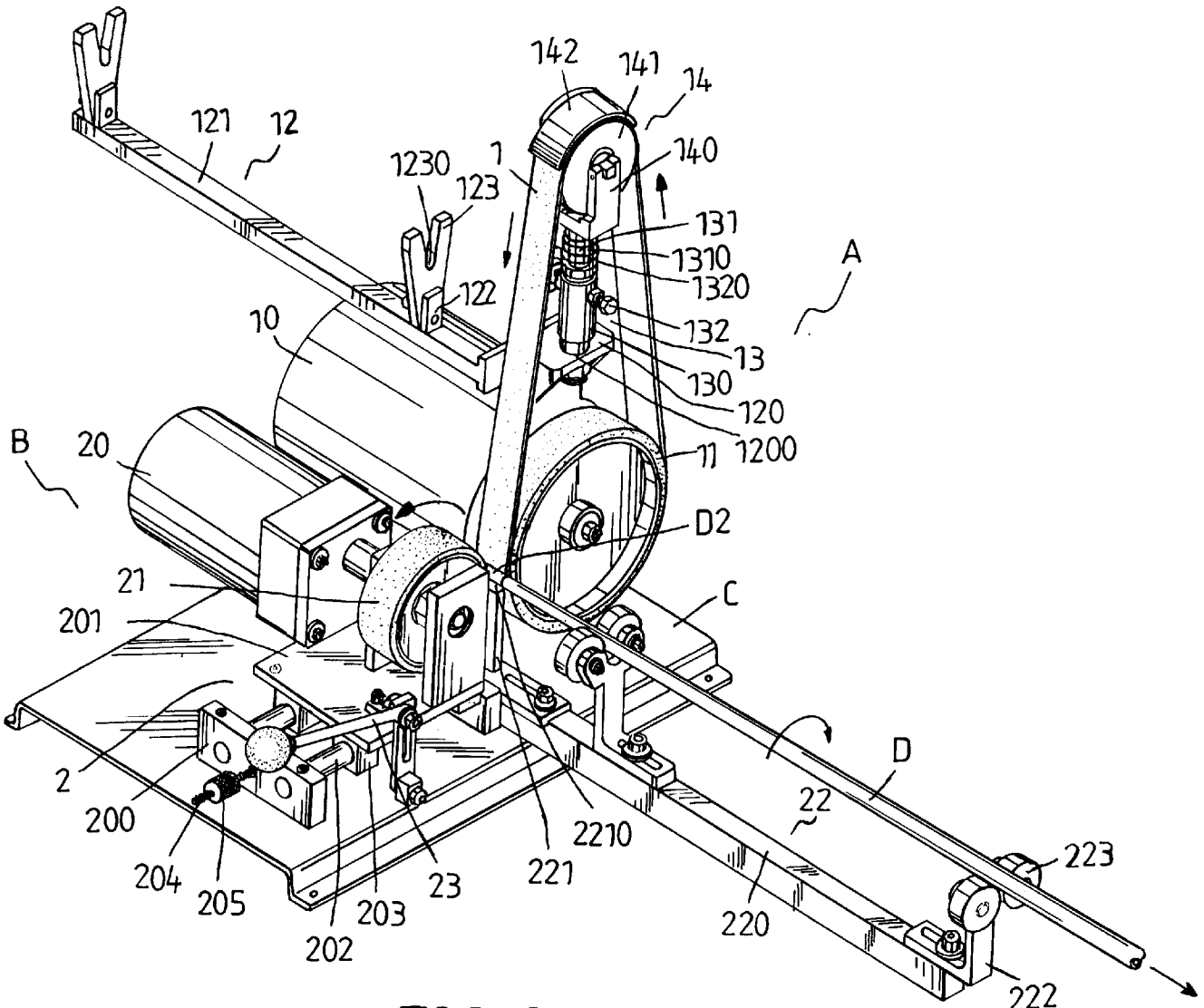
FIG. 6 is similar to FIG. 4, but showing the shaft of the golf club ground and moved outwards from the grinding position.

Referring to FIG. 4 and FIG. 1 again, the second grinding mechanism B comprises a motor carrier 2 mounted on the base frame C, a motor 20 mounted on the motor carrier 2, a wheel 21 fixedly mounted on the motor shaft of the motor 20, and a rack 22 for holding a shaft D' for golf club for grinding. The motor carrier 2 comprises two supports 200, two guide rods 202 connected in parallel between the supports 200, a carrier plate 201 having bottom blocks 203 coupled to the guide rods 202 and moved with the carrier plate 201 along the guide rods 202 between the supports 200, a switch handle 23 controlled to move the carrier plate 201 along the guide rods 202 between the supports 200, a fine adjustment screw rod 204 mounted on one support 200, and an adjustment nut 205 threaded onto the adjustment screw rod 204 and turned to adjust the position of the carrier plate 201. The rack 22 is disposed between the motor carrier 2 and the first grinding mechanism A, comprising an elongated bar 220, a locating block 221 disposed at one end of the elongated bar 220 and having a top notch 2210, two L-shaped roller holders 222 mounted on the elongated bar 220 to hold a respective pair of rollers 223.

Figure 5:
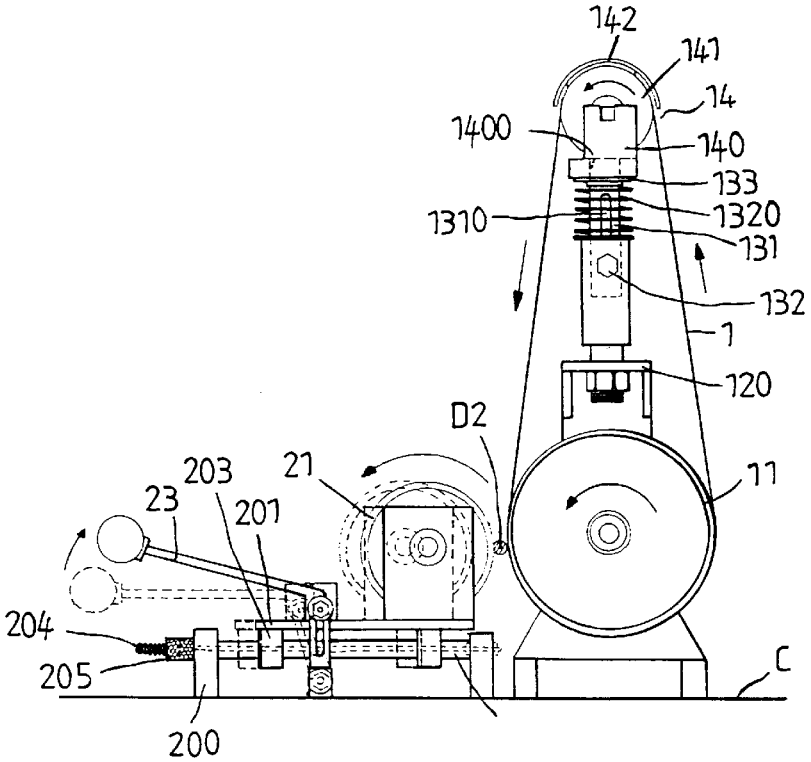
FIG. 5 is a schematic drawing showing the first grinding mechanism and the second grinding mechanism operated according to the present invention.

Referring to FIG. 5, when the shaft D' is placed on L-shaped roller holders 222 and supported on the rollers 223, the front end D2 of the shaft D' is carried on the top notch 2210 of the locating block 221, then the carrier plate 201 is moved rightwards toward the first grinding mechanism A by the switch handle 23, causing the front end D2 of the shaft D' to be retained between the wheel 21 and the abrasive belt 1. When the motors 10;20 are started, the front end D2 of the shaft D' is ground. Further, the motor 20 is mounted on the carrier plate 201 in a sloping position such that the longitudinal central axis of the motor shaft of the motor 20 slopes downwardly toward the front side. Therefore, the shaft D' is gradually moved out of the grinding position when grinding. When grinding the shaft D', the adjustment nut 205 can be turned to adjust the pitch between the wheel 21 and the abrasive belt 1.

It is to be understood that the drawings are designed for purposes of illustration only, and are not intended as a definition of the limits and scope of the invention disclosed.

I claim:

1. A golf club grinder comprising:

a base frame;

a first grinding mechanism mounted on said base frame and adapted for grinding a hosel of a golf club, said first grinding mechanism comprising a motor having a motor shaft, a driving wheel fixedly mounted on the motor shaft of the motor of said first grinding mechanism, a rack fixedly mounted on a shell of the motor of said first grinding mechanism in horizontal, an adjustment device, a roller holder assembly, and an abrasive belt, the rack of said first grinding mechanism being fixedly mounted on the shell of the motor of said first grinding mechanism at a top side thereof in a horizontal position and comprising a substantially L-shaped frame having around hole, an elongated bar extended from one side of the L-shaped frame and disposed in a horizontal position, two upright lugs vertically raised from the elongated bar near its two opposite ends, and two fork members respectively fastened to said upright lugs and defining a respective top gap for holding a golf club for grinding, said adjustment device of said first grinding mechanism comprising a top-open socket mounted in the round hole of said L-shaped frame, a round rod having a bottom end inserted into said top-open socket and a longitudinal locating groove at its periphery and a top end coupled to said roller holder assembly, a tightening up screw threaded into a screw hole in said top-open socket and stopped at said longitudinal locating groove to hold down said round rod in said top-open socket, a spring mounted around said round rod and stopped above said top-open socket, and a cushion mounted around said round rod and stopped between said spring and said roller holder assembly, said roller holder assembly comprising a U-shaped roller holder having a round hole at the center which receives the top end of said round rod, a roller mounted on said U-shaped roller holder, and an arched guard connected to said U-shaped roller holder and spaced around the periphery of said roller by a gap through which said abrasive belt passes, said abrasive belt being mounted on said driving wheel and the roller of said roller holder assembly and protected by said arched guard; and a second grinding mechanism mounted on said base frame to act with the abrasive belt of said first grinding mechanism for grinding a shaft for golf club, said second grinding mechanism comprising a motor carrier mounted on said base frame, a motor mounted on said motor carrier and having a motor shaft, a grinding wheel fixedly mounted on the motor shaft of the motor of said second grinding mechanism, and a rack for holding a shaft for golf club for grinding, said motor carrier comprising two supports, two guide rods connected in parallel between said supports, a carrier plate having bottom blocks coupled to said guide rods and moved with said carrier plate along said guide rods between said supports, a switch handle controlled to move said carrier plate along said guide rods between said supports for permitting said grinding wheel to be moved toward said abrasive belt or away from it, a fine adjustment screw rod mounted on one of said supports, and an adjustment nut threaded onto said adjustment screw rod and turned to adjust the pitch between said grinding wheel and said abrasive belt when said grinding wheel is moved close to said abrasive belt, the rack of said second grinding mechanism comprising an elongated bar, a locating block disposed at one end of its elongated bar and having a top notch for receiving the front end of the shaft for golf club to be ground, two L-shaped roller holders mounted on its elongated bar to hold a respective pair of rollers for supporting the shaft to be ground, the motor of said second grinding mechanism being disposed in a forwardly tilted position so that the longitudinal axis of the motor shaft of the motor of said second grinding mechanism slopes forwardly downwards.

* * * * *